US005451006A

United States Patent [19]

Smith

[11] Patent Number: 5,451,006

[45] Date of Patent: Sep. 19, 1995

[54] YARN DELIVERY

[76] Inventor: Colin P. Smith, Arngibbon, Legh Road, Knutsford, Cheshire, WA16 8NT, United Kingdom

[21] Appl. No.: 87,795

[22] PCT Filed: Jan. 16, 1992

[86] PCT No.: PCT/GB92/00090

§ 371 Date: Jul. 14, 1993

§ 102(e) Date: Jul. 14, 1993

[87] PCT Pub. No.: WO92/13123

PCT Pub. Date: Aug. 6, 1992

[30] Foreign Application Priority Data

Jan. 16, 1991 [GB] United Kingdom ..... 9100954

[51] Int. Cl.[6] ..... D02H 1/00

[52] U.S. Cl. ..... 242/131.1; 28/193

[58] Field of Search ..... 242/131, 131.1; 28/190, 28/193

[56] References Cited

U.S. PATENT DOCUMENTS

| | | | |
|---|---|---|---|
| 727,190 | 5/1903 | Ohleyer | 242/131.1 |
| 1,275,850 | 8/1918 | Colman | 242/131.1 |
| 1,940,477 | 12/1933 | Abbott | 28/35 |
| 2,177,855 | 10/1939 | Balch et al. | 242/131.1 |
| 3,110,951 | 11/1963 | Seelig | 242/131.1 |
| 3,377,677 | 4/1968 | Fürst | 28/193 |
| 3,477,661 | 11/1969 | Emerson et al. | 242/131 |
| 3,731,889 | 5/1973 | Alexeff | 242/131 X |
| 4,512,373 | 4/1985 | Trost | 242/131 X |
| 4,664,335 | 5/1987 | Kohlen | 242/131.1 |
| 4,852,824 | 8/1989 | Beitz et al. | 242/131.1 |

FOREIGN PATENT DOCUMENTS

| | | | |
|---|---|---|---|
| 039561 | 11/1981 | European Pat. Off. . | |
| 883727 | 6/1953 | Germany | 242/131.1 |
| 3128933 | 3/1983 | Germany . | |
| 025880 | 3/1988 | Germany . | |
| 8908732 | 9/1989 | WIPO . | |

*Primary Examiner*—Daniel P. Stodola
*Assistant Examiner*—Michael R. Mansen
*Attorney, Agent, or Firm*—Richard E. Jenkins

[57] ABSTRACT

A yarn delivery system including a trolley creel and a yarn guide apparatus. The trolley creel is made up of a plurality of independently moveable trolleys and each includes a set of rotatable yarn packages. When each trolley is moved into place, the yarn guide apparatus is vertically spaced therefrom. As yarns are drawn vertically from the creel, the yarn guide apparatus vertically guides them.

7 Claims, 3 Drawing Sheets

YARN DELIVERY

BACKGROUND OF THE INVENTION

This invention relates to the delivery of yarn from wound yarn packages on a creel. The invention is of particular, but not exclusive, interest in relation to the delivery of a warp sheet directly to a fabric-producing machine, especially of a tire cord warp sheet to a loom for weaving tire reinforcement fabric.

Creels are known in which the yarns are drawn through the creel to a front guide stand having with a large number of thread guides, and thence to a fabric-producing machine. One such creel is a fixed position creel to which the yarn packages are brought, for example in skips, buggies or on pallets, for re-loading. When it is required to replace the yarn packages on the fixed creel, the creel is re-loaded in situ. The yarn from each yarn package is knotted to the retained end of the respective previous yarn drawn from the creel, adjacent the yarn package or at the front of the creel. This loading operation takes considerable time. During this time, the fabric-producing machine may be shut down. Alternatively, it may be fed with yarn from an adjoining creel, two creels being located upstream of the fabric-producing machine. This is not space-efficient. Furthermore, it will be appreciated that the yarn packages undergo considerable handling between their winding on and their placement on the creel. They must be transported from the winding machine to the creel, and moreover there must generally be two stages to the transportation because it is the practice to leave a newly wound yarn package for a period of time between winding and use, to allow the yarn time to "relax".

Tire cord yarn packages have heretofore generally been flanged bobbins with a yarn weight of 2 to 3 Kg. However, these are proving of inadequate size, in view of the faster weaving and knitting machines which are now available. For example, if a loom can operate at a speed three to four times greater than a traditional loom, as is now proving possible, the bobbins are unwound in a third to a quarter of the previous unwinding time. Once unwound, the creel must be reloaded. Overall productivity has not therefore increased as much as the greatly superior performance of modern looms and warp knitting machines should allow.

One approach might be to simply scale up from the system described above, and use much larger flanged bobbins. In the context of tire cord yarn packages, a yarn weight of about 10 to 12 Kg would be suitable. However this necessitates very heavy and costly winding machines and a very large investment in flanged bobbins.

Flangeless, cross-wound yarn packages, for example produced by means of the modern Cabler twisting machine, would be preferred. Production of such yarn packages, commonly known as "cheeses", would be more economical than production of very large yarn packages using flanged bobbins. Flangeless, cross-wound yarn packages have the further advantage that they may be wound onto cheap tubular cores, for example of cardboard.

However, flangeless cross-wound yarn packages are much more delicate than yarn packages wound onto flanged bobbins, since they have no end constraints. Therefor they must be handled more carefully and is it desirable to minimise handling operations.

A further type of creel which has been employed, and through which yarn has been drawn towards a fabric-producing producing machine, is the trolley creel, which is made up of a number of independently movable trolleys, which can be loaded directly from the winding machine, and moved into place as part of the creel when required. The trolley creel therefore offers the advantage over the fixed creel that yarn package handling is minimised. No intermediate double handling is necessary. Thus, it is more desirable, from the point of view of handling, to use a trolley creel for cross-wound yarn packages, than a fixed creel. It might be thought, therefore, that the problems of delivering yarn efficiently to a modern fast fabric-producing machine could be solved by using large cross-wound supply packages on scaled-up trolley creels. However, it takes longer to assemble and thread up a trolley creel than it does to re-load and thread up a fixed creel. When the empty set of trolleys is taken away to the winding area for re-loading, all that remains is the fixed front set of yarn guides immediately upstream of the fabric-producing machine. Thus when the new set of trolleys is brought into position, all yarns from each trolley must be threaded forward to the fixed front guide stand for knotting in. The loom stop time is in fact that required to cut the previous array of yarns at each joint between trolleys, remove the empty trolleys, install a new full set of trolleys, to thread all the yarns through the creel forward to the guide stand behind the loom, which can be a time-consuming operation, and finally to knot in and pull the knots through. The loom stop time is considerably longer than for the fixed creel, mainly because of the threading-through operation; and the larger the creel, the more time consuming is the threading-through operation.

SUMMARY OF THE INVENTION

In accordance with a first aspect of the present invention there is provided a yarn delivery system comprising a creel for supplying yarns, the creel comprising a set of yarn packages of the rotating type, wherein yarns are drawn from the creel by movement upwardly and/or downwardly from the creel, and a yarn guide apparatus to guide the yarns drawn from the creel.

The yarns are conveniently drawn upwardly and/or downwardly from the creel substantially vertically, for example within about 10° of the vertical, though embodiments in which the yarns are drawn upwardly and/or downwardly at a more slant angle to the vertical, are possible.

Preferably, the yarns are drawn from the yarn packages to the top and/or bottom of the creel by movement directly upwardly and/or downwardly from the yarn packages.

Preferably there are no intermediate guide systems between the yarn packages and the top and/or bottom of the creel.

The yarn packages of the rotating type are also known as packages of the tangentially unwinding type or unrolling type.

Preferably, the creel is a trolley creel. Preferably, the trolley creel is made up of a plurality of independently movable trolleys. The trolleys may be movable on castors or wheels, for example at respective corners of the trolleys or at one pair of corners, being towable on connection of a wheeled tug bar apparatus. They may be movable using a lifting vehicle such as a forklift truck. To this end they may be retained on pallets or have frameworks adapted for lifting forks. They may be movable by means of a hover skirt.

Preferably, the yarn packages on the creel are flangeless cross wound yarn packages. Such packages may be either random cross wound or precision wound.

Preferably, the yarn packages on the creel have their axes of rotation substantially horizontal.

Preferably, the yarn guide apparatus is arranged to guide the yarns lengthwise with respect to the creel, towards a fabric-producing machine or other yarn handling machine. Thus, when a yarn delivery system in accordance with the invention is such that yarns are drawn from the creel by movement upwardly from the creel, such a yarn guide apparatus may be located above the creel. When a yarn delivery system in accordance with the invention is such that yarns are drawn from the creel by movement downwardly from the creel, such a yarn guide apparatus may be located under the creel. When a yarn delivery system in accordance with the invention is such that some yarns are drawn from the creel by movement upwardly from the creel, and some, by movement downwardly of the creel, such a yarn guide apparatus may be located above the creel, and another, under the creel.

The yarns drawn from the creel may constitute a warp sheet drawn to a downstream machine, for example an impregnation, lamination, coating or pultrusion machine, or to a fabric-producing machine, for example a loom or a warp knitting machine. It is also possible that the yarns be supplied to a warping machine, for example a modern section warper, though, preferably there is no intermediate warping step.

Whilst a yarn delivery system wherein yarns are drawn from the creel by movement downwardly from the creel may be envisaged, for example with a channel beneath the creel, or with such a creel being located on a mezzanine floor, with the fabric-producing machine which it is supplying located on the floor below, a preferred system is such as to draw yarns from the creel exclusively by movement upwardly from the creel.

Suitably, a yarn guide apparatus, which is preferably a fixed structure, whether the creel is a trolley creel or a fixed creel, comprises, spaced vertically from the creel, through which yarns from the creel pass, a plurality of guides, preferably one for each yarn, and, at one end of the yarn guide apparatus, a common guide part, through which yarns pass towards the fabric-producing machine.

Preferably, the creel is of the compact type in which the yarn packages are arranged in a plurality of arrays, each array being made up of closely spaced columns and rows of yarn packages, with the arrays being closely spaced, with the axes of rotation of the yarn packages of one array being parallel or co-axial with the axes of rotation of the yarn packages of another array. It should be noted moreover that the system in accordance with the present invention permits a closer packing of yarn packages than can be achieved in the prior art yarn delivery systems described above. In those systems, the horizontal spacing of yarn packages can be very close, but the vertical spacing cannot be so close; close vertical spacing of the yarn packages would result in difficulties in handling yarns, at the common guide part to which they pass. Typically, in the prior art creels, a standard clear gap, typically of at least 50–100 mm, or more, must be left between fully wound packages, in the vertical direction, for hand access. Thus, a novel feature of the yarn delivery system of the present invention is the location of yarn packages with a clear gap left between them, in their fully wound condition, of less than 100 mm, preferably less then 50 mm and most suitably about 5–25 mm, in the vertical direction.

The yarn delivery system of the present invention is particularly suitable for delivery of yarns from large yarn packages, for example from yarn packages at least 5 Kg, preferably at least 10 Kg, in weight of yarn.

The term "yarn package" as used herein is of broad meaning and could even denote very large packages such as those known in the art as "beams" or "back beams", although much smaller yarn packages are generally employed, preferably carrying no more than 30 Kg of yarn, and most preferably no more than 20 Kg.

Preferably, the yarn delivery system comprises a movable creel, as described above, and fixed yarn guide apparatus, as described above, the creel having means for releasably retaining the unwound (front) end of the yarn of each yarn package on the creel, and the yarn guide apparatus having means for releasably retaining the free (rear) end of each yarn previously supplied, after yarn cutting. Thus, on removal of a spent creel, the yarns will be cut between the creel and the yarn guide apparatus and the yarn ends in the yarn guide apparatus "parked" in the appropriate yarn-retaining means. Fresh trolleys are then located in place, the yarn ends of the new yarn packages having been "parked" in their respective retaining means at the time of placement of the yarn packages on the creel. Knotting in is then a relatively simple operation which can be carried out suitably in a common horizontal plane.

Many different types of retaining means can be envisaged. One cheap and convenient retaining means comprises two cup washers mounted back-to-back, preferably under spring loading.

Preferably, the creel, or each trolley thereof in the case of a trolley creel made up of several trolleys, has a framework which includes corner columns, for example of angle-iron or tube. These corner columns help to protect the yarn packages on a trolley from damage while being loaded, stored and transported, and stiffen and stabilise the creel. This is particularly beneficial when the yarn packages are the relatively delicate cross-wound flangeless "cheeses", as is preferred. This is in contrast to the structure of the type of prior art creel through the body of which yarns had to be pulled. In such creels, the provision of columns at intervals along the outside of the framework would be very undesirable because it would hinder the operator in pulling through the yarns. At each corner column the operator would have to stop, change hands and continue. For this reason prior art creels tend to have a very strong central framework and no frame members on the outside of the framework. In the yarn delivery system of the present invention, the operator does not pull yarns through the length of the machine, and so external frame members such as corner columns can be employed, with advantage.

Preferably, the yarn delivery system comprises means for providing that the unwound yarn from each yarn package on a trolley prior to location of the trolley in a creel made up of trolleys is under tension.

Preferably, the yarn delivery system comprises means for controlling the tension in the yarn drawn from each yarn package.

Suitably, the means for controlling the tension of the yarn drawn from each yarn package may be a system in which the tension of all yarns drawn from yarn packages on the creel may be adjusted by a common tension adjustment mechanism. Various common tension adjustment mechanisms have been proposed for use with fixed creels. We have now devised a common tension adjustment mechanism which can be used with trolley creels. Such a common tension adjustment mechanism may be used in relation to the yarn delivery system of the present invention, when such comprises a trolley creel. It may also be employed in the context of other types of yarn delivery system, for example prior art systems, which employ trolley creels.

Such a common tension adjustment mechanism may be broadly defined as comprising a set of adjuster members, one for each trolley, each adjuster member being releasably connectable to a single main adjuster.

Suitably means are provided for retaining free end portions of yarn packages under tension when an adjuster member is disconnected from the main adjuster.

Preferably the adjuster members are mounted on trolleys and the main adjuster is mounted on the yarn guide apparatus.

Preferably the adjuster members when connected to the main adjuster rise and fall when the main adjuster is moved lengthwise.

The main adjuster may comprise a horizontal bar. From the bar may be suspended a plurality of straps, each passing over a portion of the periphery of a respective pulley. Suitably there are two straps for adjuster member, supporting a respective end region thereof. The pair of straps above each trolley may be quickly connected to the respective adjuster member below, to which are connected a series of upright rods, entrained in guides in the trolley frame, for lengthwise movement. Each rod carries a plurality of simple spring and strap tensioning devices, one for each yarn package in a column of yarn packages. The strap of such a device is fixed at one end to the creel frame and passes over a portion of the periphery of a pulley wheel, located inwardly of the yarn package. The other end of the strap is secured to one end of a tension spring, the other end of which is secured to a part carried directly by the rod. When all the adjuster members are connected to the main adjuster for common movement, axial movement of the main adjuster causes raising or lowering of each of the adjuster members, and hence of the rods, by an equal amount, and therefore causes equal changes in tension in each of the springs associated with respective yarn packages.

An alternative approach is to provide such a set of adjuster members with means for connecting them together lengthwise, whereby they can themselves then serve as the main adjuster.

In some circumstances it may not be necessary to provide a common tension adjustment mechanism. In such embodiments it may be desirable to use a conventional gravity system of yarn tensioning.

It will be appreciated that the yarn delivery system of the present invention and/or preferred aspects or embodiments thereof, may offer various advantages over earlier systems.

For example, the present invention enables a trolley creel to be employed with very much easier re-threading of yarns on changeover. The need for complete re-threading of the yarn through the entire creel system is eliminated. Thus, the creel changeover time, and therefore the downstream machine stop time, is minimised, so allowing the efficiency of modern fast looms or knitting machines to be maximised.

Access to the full complement of yarns, for threading, tying in and quality inspection is good. All yarns may now be accessed and viewed, if required, from the same level, whereas on the conventional creel described above the yarns run at several different levels. The geometrical arrangement which can be achieved by use of the present invention would facilitate automation of the operation of cutting out, changing creel sections, and knotting in.

The yarn delivery system of the present invention enables lower and therefore more stable creel design, because the vertical pitch between yarn packages can be minimised.

There are fewer constraints on frame design than in systems employing prior art creels. Thus, rigid columns can be incorporated at each corner of each creel section.

In accordance with a further aspect of the present invention there is provided a creel per se, for use in a yarn delivery system as hereinbefore described.

In accordance with a further aspect of the present invention there is provided a yarn guide apparatus per se, for use in a yarn delivery system as hereinbefore described.

In accordance with a further aspect of the present invention there is provided a method of delivering yarn, comprising the use of a yarn delivery system as hereinbefore described.

The present invention is of particular interest in relation to the production of fabrics for the reinforcement of automotive tires. It is desirable that the yarn for such a fabric be provided at a constant tension. Twist should not be added to the yarn by the creel, so tangential unwinding is required. Knotting in operations should be reliably performed and a high level of quality control is required. Because it is now desirable to weave such fabrics on fast looms, large yarn packages should desirably be used, and creel changeover time should be minimised.

A yarn delivery system in accordance with the present invention is very suitable for delivering yarn for the manufacture of tire reinforcement fabric and the use of such a yarn delivery system in a method of producing such fabrics constitutes a preferred aspect of the present invention.

BRIEF DESCRIPTION OF THE DRAWINGS

The invention will now be further described, by way of example, with reference to the accompanying drawings in which.

DESCRIPTION OF THE PREFERRED EMBODIMENTS

Figure 1:
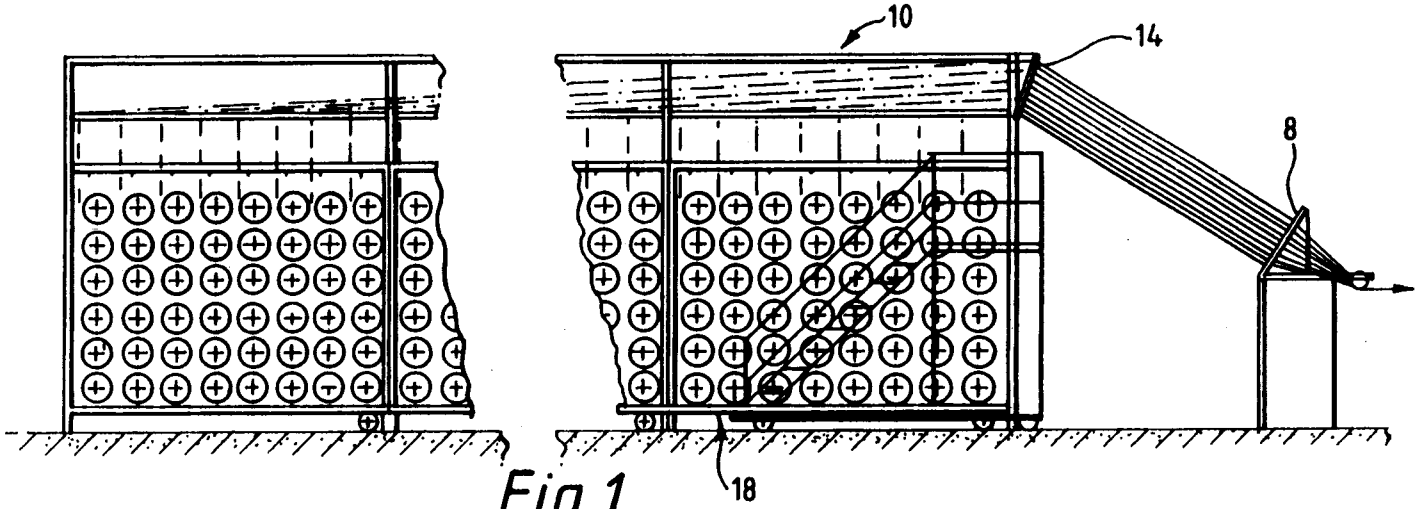
FIG. 1 shows a yarn delivery system in side view.

The exemplified yarn delivery system will firstly be described with reference to FIGS. 1 to 4, which show a yarn delivery system for delivering tire cord yarn to a loom (not shown) weaving tire reinforcement fabric.

The yarn delivery system of this embodiment comprises two creels 2, 4, arranged side by side, with a gap between them just big enough for passage of a set of wheeled inspection steps 6 (though in some situations one or three creels might be needed). Both creels 2, 4 feed a common condenser board 8 from which the yarns pass, as warp yarns, directly to a loom (not shown). To get from the respective creel 2, 4 to the condenser board, the yarns are drawn upwardly from the respective creel, into a respective yarn guide apparatus 10, 12. The yarn guide apparatus 10 extends above the creel 2 for its whole length, and the yarn guide apparatus 12 extends above the creel 4 for its whole length. At the front of the respective yarn guide apparatus 10, 12 is a respective guide plate 14, 16, from which yarns pass downwardly, at a slant angle to the vertical, to the condenser board 8.

The creel 2 and yarn guide apparatus 10 is identical to the creel 4 and yarn guide apparatus 12 and only the creel 2 and yarn guide apparatus 10 will be described in detail hereafter.

The creel 2 is made up of a plurality of identical trolleys 18 placed in endwise relationship, the number of trolleys employed depending upon the number of yarns which are required. Each trolley has a rigid framework made up of vertical centre columns 20 and corner columns 22, upper and lower horizontal cross-members 24 and 26, and upper and lower horizontal longitudinal members 28, 30. Sets of horizontal pins for the mounting of yarn packages are carried by centre columns, on opposite sides thereof. In these particular trolleys eight central columns each carry six horizontal pins to one side, and six horizontal pins to the other side. On each pin is mounted a large cross-wound flangeless "cheese", carrying about 12 Kg of yarn. Thus, each trolley is of the compact type in which the "cheeses" are arranged in two side-by-side, closely spaced arrays of vertical columns and horizontal rows, with the "cheeses" to one side of the central columns all having parallel axes, and each being co-axial with respective "cheese" located on the other side of the central columns. Thus, in this embodiment each trolley has 96 "cheeses".

It will be observed that the spacing between the "cheeses" of an array is very close. In particular the gap Z between fully wound adjacent "cheeses" in the vertical direction is about 15–20 mm.

In this embodiment each trolley has a pair of wheels 32 located at its front (nearest the loom) end. At its back end, it has corner support brackets 34. It also has, at its back end, a securement device (not shown) for connection to a wheeled tug bar apparatus.

The yarn guide apparatus 10 comprises a framework which is fixed in place. It has vertical support columns 36 mounted to the floor and horizontal members, transverse and longitudinal, for example those marked as 38 and 40, and 42. The trolleys may conveniently be moved into place beneath the yarn guide apparatus by lengthwise movement from the back.

From each column of "cheeses" of each trolley, the six yarns pass through the top of the creel and thence through respective ceramic eyelets 44 which are located in respective apertures in a respective plate 46 mounted to a horizontal frame member of yarn guide apparatus, in the lower region of the yarn guide apparatus.

When the creel is operative each of the six yarns of a column passes through a respective eyelet in the plate 46, and is then drawn at a slant angle to the horizontal, to the front guide plate 14.

Figure 6:
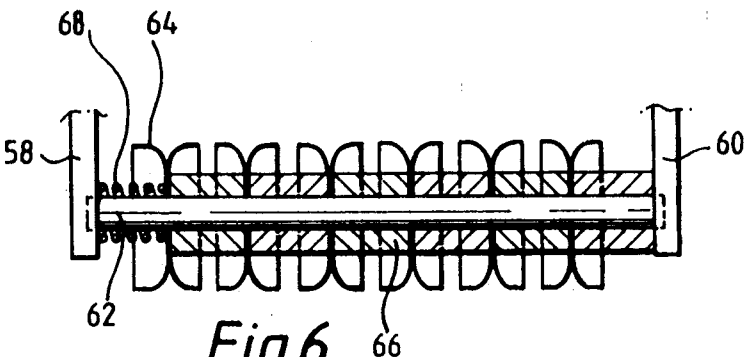
FIG. 6 shows in cross-section yarn retaining means of the yarn delivery system.
Figure 5:
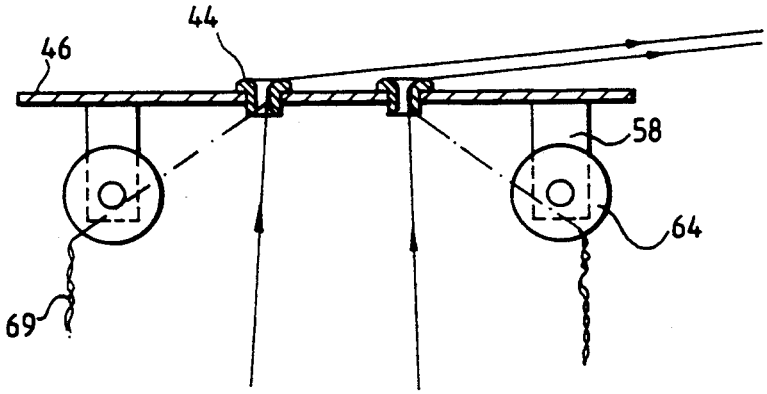
FIG. 5 shows in cross-section a detail from the upper part of the yarn delivery system.

Each trolley has a yarn retainer for each yarn. Moreover, the overhead guide apparatus has a yarn retainer for each yarn. Each trolley yarn retainer is mounted across the top of the trolley, to the frame thereof, whilst the guide apparatus yarn retainers are mounted on the apertured plates 46, so as to be located just below and to the side of the eyelets (see FIG. 5). Thus, FIG. 6 shows a simple arrangement whereby two side members 58, 60 are carried by the plate 46, and mounted between them is a rod 62. On the rod are located six pairs of opposed cup washers 64, which act as the retainers, a plurality of spacer members 66 and, between part 58 and the first pair of cup washers 64, a helical compression spring 68. A hanging yarn end 69 may be simply pulled between a pair of cup washers 64 in order to be retained in place, as shown in FIG. 5. A similar arrangement is employed on the creel.

When new "cheeses" are required, the yarns are cut between the upper part of the creel and the lower part of the yarn guide apparatus. The loose ends hanging from the yarn guide apparatus are secured in the appropriate retainers to keep them under control. The trolleys are wheeled away.

Fresh trolleys loaded with full "cheeses" are then located in place. These trolleys were loaded directly from a winding machine. At the winding machine, each yarn end on each trolley was drawn upwards, into the appropriate retainer. Following the trolley loading operation at the winding machine, the trolley was then wheeled away from that area to a storage area, to "relax" for a period of time, in order to permit the yarns to stabilise, and to provide buffer stock. At the end of this period the trolleys are then wheeled into place beneath the fixed guide apparatus as soon as the previous set of trolleys are wheeled away for reloading. Operatives then simply knot the appropriate yarn ends from the new creel to the yarn ends of the overhead guide apparatus, and operation can re-commence without any need for re-threading.

Figure 2:
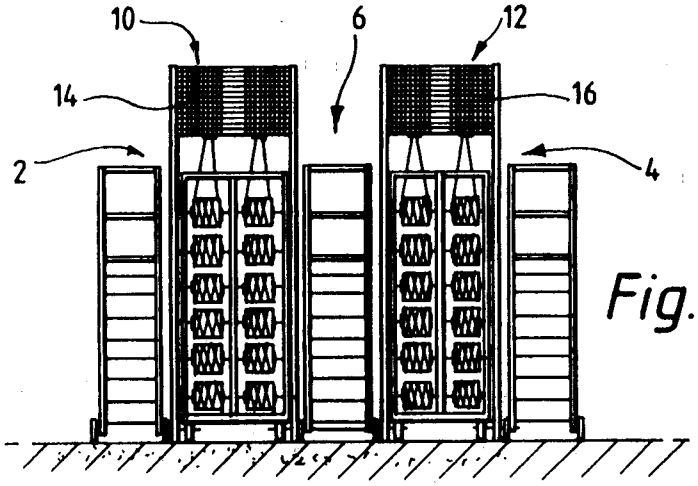
FIG. 2 shows the yarn delivery system of FIG. 1, in end view.
Figure 4:
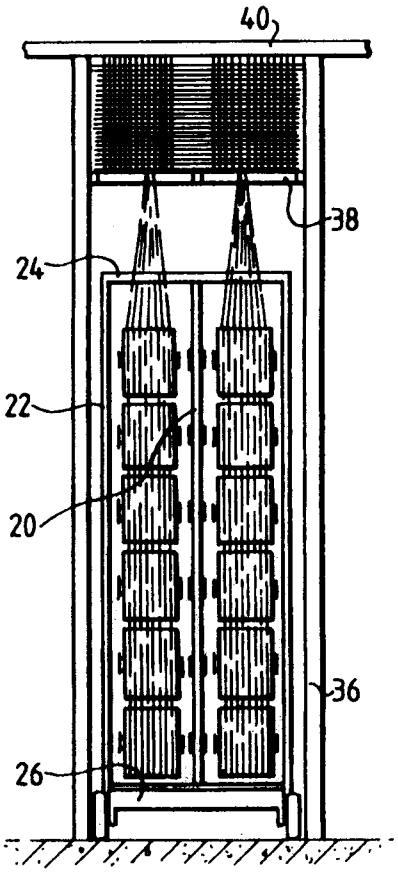
FIG. 4 is an end view corresponding to FIG. 3, in greater detail.
Figure 3:
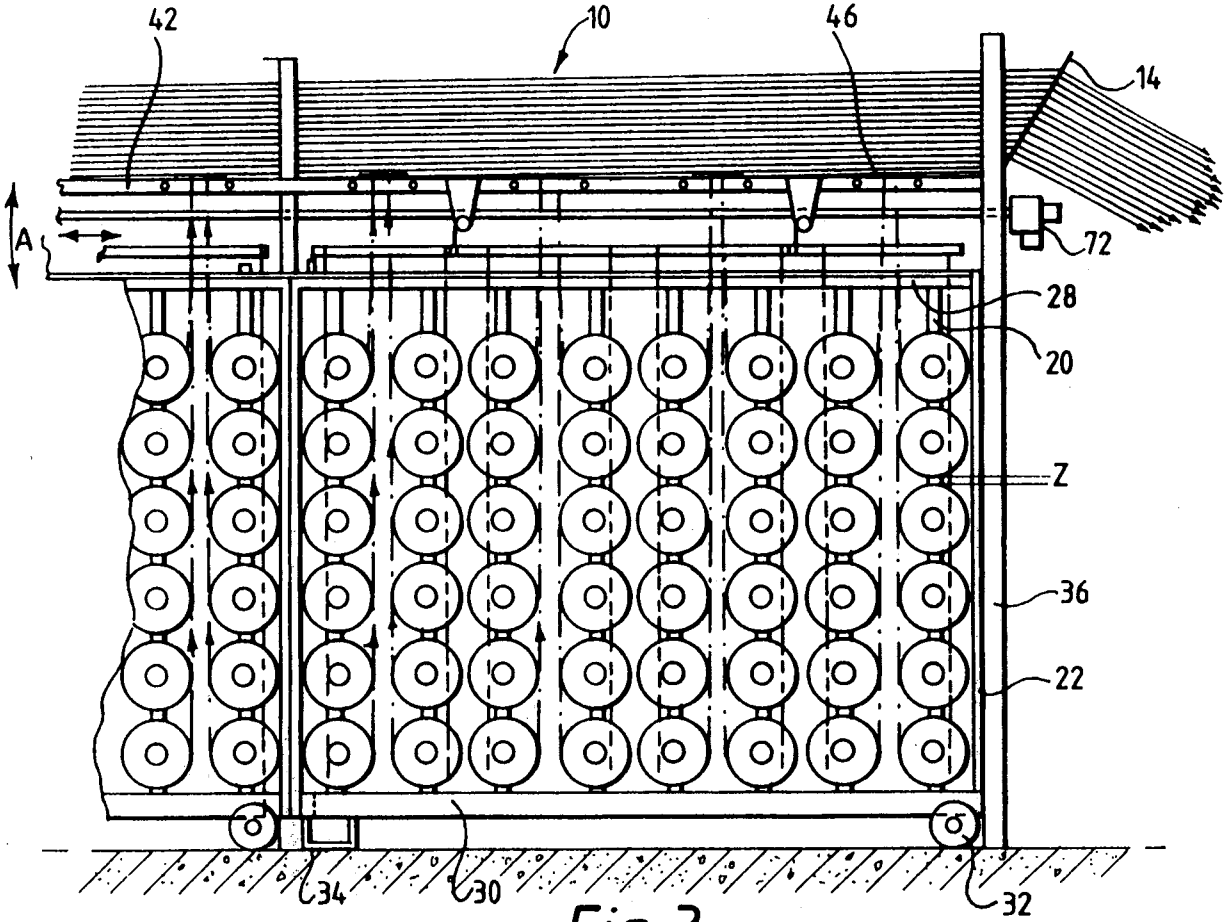
FIG. 3 shows the front trolley of the yarn delivery system of FIG. 1, and the front part of the next trolley, in greater detail.

It will be observed that there is an adequate gap A between the upper part of the creel and the lower part of the guide apparatus, to enable ease of access and inspection by operatives. Operatives may stand on wheeled inspection steps 6 to the side of creels, for example between two creels as shown in FIGS. 1 and 2, and may simply pull the steps along the creel by gripping the fixed framework of the guide apparatus 10, 12. Alternatively, a platform may be provided around the creel, at an appropriate height for operatives to walk on, such that they are at about eye level with the gap A.

In this embodiment, the yarn delivery system is delivering tire cord yarn to a loom weaving reinforcing fabric for automotive tires. It is important that the yarns are delivered to the loom at a constant predetermined tension. The yarn delivery system therefore has a mechanism for commonly adjusting the tension of the yarns when they are being drawn from the creel, during operation. Moreover there are means such as to cause tensioning of yarns retained on the trolleys prior to set-up in a creel. Such tensioning is advantageous because it acts to hinder loose movement of the "cheeses" about the pins, for example during transportation.

Figure 7:
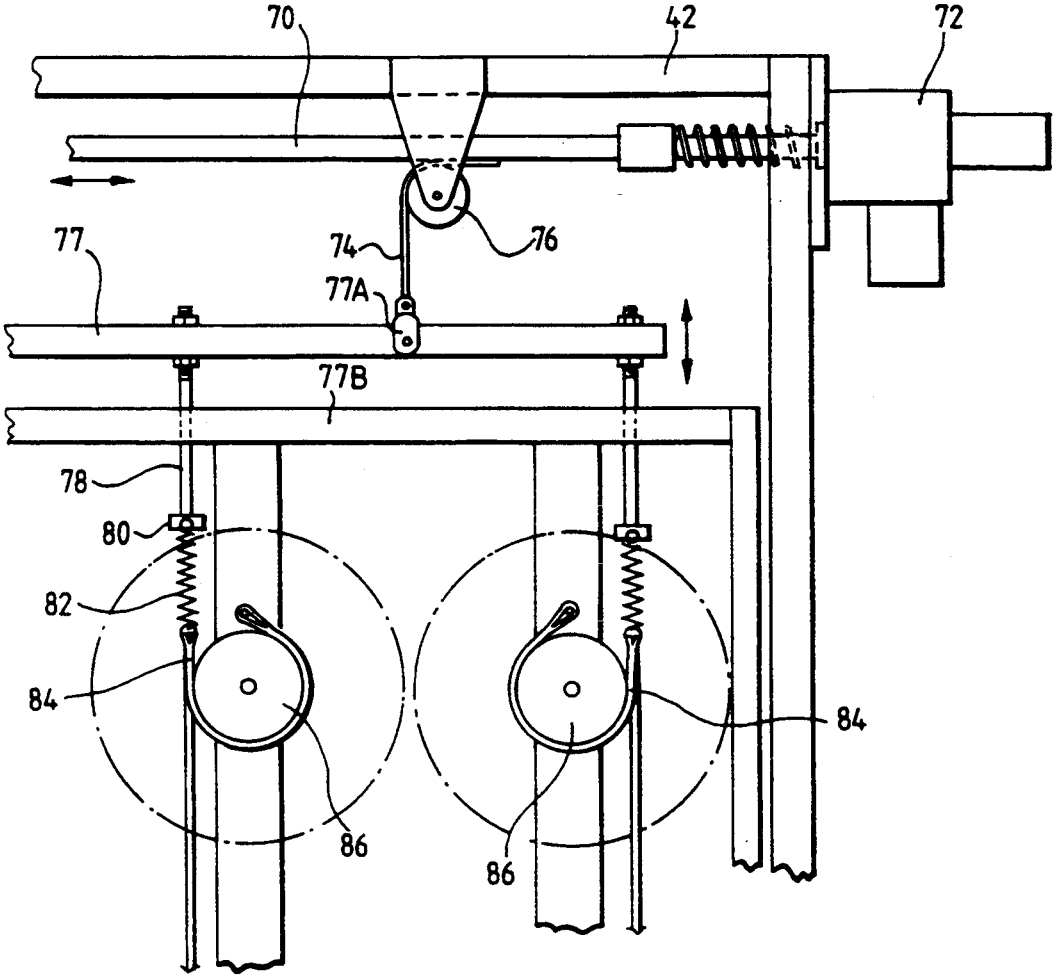
FIG. 7 shows in schematic side view a portion of a common tension adjustment mechanism for the creel of the yarn delivery system.

For simplicity the common adjustment mechanism is not shown in detail in FIGS. 1 to 6, and reference should now be made to FIG. 7, which shows the upper front part of a trolley.

During an unwinding operation the common adjustment mechanism works in exactly the same way as a known common adjustment mechanism used on fixed creels, in that a main adjuster 70, in the form of a bar, mounted horizontally above the creel, longitudinally thereof and extending along its entire length, may be moved back and forth by an actuator 72, located at one end of the bar. This may be of standard type. A plurality of straps 74 are secured to the bar 70 and hang from it. Each strap 74 passes over a portion of the periphery of a respective pulley 76 mounted to a longitudinal frame member 42 of the overboard guide apparatus. There are two such pulleys and straps above each trolley. The lower end of the strap 74 is attached by a quick connector 77A to a horizontal bar 77, acting as an adjuster member for a single trolley. The bar 77 extends above the trolley. From the bar 77 are suspended a number of vertical control rods 78, entrained for up and down movement in respective holes in horizontal frame members of the trolley. On each rod 78, there is a short cantilevered member 80 adjacent to each "cheese". From each member 80 hangs a respective helical tension spring 82, to the lower end of which is secured a tensioning strap 84 which passes around a portion of a tensioning pulley wheel 86, co-rotational with the "cheese", and providing a drag force against which the yarn must be drawn.

It will be appreciated that, should the adjuster be moved so as to draw the bar 70 to the right in FIG. 7, all the control rods 78 will be lifted by an equal amount, and the tensioning forces provided by all the springs 82 will be increased by an equal amount, and thus the drag forces provided by the action of all the straps 84 on the respective pulley wheels will be increased by an equal amount.

When it is desired to remove the trolleys of a spent creel, all the quick connectors 77A are detached from the bar 77 enabling the trolleys to be removed.

When a trolley is loaded with fresh "cheeses" it is desirable that they are restrained against free rotation, with the unwound yarn therefrom being under tension. Thus it is desirable that springs 82 are under some tension even when bar 77 is disconnected from the bar 70. To this end stop members (not shown) may be located between bar 77 and trolley frame member 77B shown in FIG. 7, to limit the extent to which bar 77 can drop.

In certain situations, for example when the yarn tension requirements are not so onerous as they are for tire fabrics, a common tension adjustment mechanism may not be required. A simple known tensioning pulley, employing a weighted strap, one for each yarn package, may be employed.

I claim:

1. A yarn delivery system comprising (A) a creel for supplying yarns, each of the yarns having a free end, and the creel being a trolley creel made up of a plurality of independently movable trolleys and each movable trolley having a set of rotatable yarn packages rotatably mounted thereon, wherein the yarns are drawn from each moveable trolley of the creel by movement of the yarns substantially vertically from each moveable trolley of the creel, and (B) a yarn guide apparat having a forward end and being fixedly mounted in relation to floor so that when each moveable trolley is moved into place in relation to the yarn guide apparatus the yarn guide apparatus is vertically spaced from each moveable trolley so as vertically to guide the yarns drawn from each moveable trolley of the creel.

2. A yarn delivery system as claimed in claim 1, wherein each yarn is drawn from each associated yarn package by movement of each yarn substantially vertically.

3. A yarn delivery system as claimed in claim 1, wherein each moveable trolley has means for releasably retaining the free end of the yarn of each yarn package of the respective moveable trolley, and the yarn guide apparatus has means for releasably retaining the free end of each yarn supplied by the previous moveable trolley.

4. A yarn delivery system as claimed in claim 1, comprising means for commonly adjusting the tension of each yarn drawn from the creel.

5. A yarn delivery system as claimed in claim 1, wherein the yarn packages are flangeless cross wound yarn packages.

6. A yarn delivery system as claimed in claim 1, wherein all of the yarns of each moveable trolley of the creel are drawn vertically upwardly from the creel and the yarn guide apparatus comprises a single yarn guide provided above the creel.

7. A yarn delivery system as claimed in claim 1, wherein the yarn guide apparatus comprises (i) a plurality of yarn guides, through which yarns from each moveable trolley pass, and, (ii) at the forward end of the yarn guide apparatus, a common guide part, through which yarns pass.

* * * * *